US005106457A

United States Patent [19]

Manning

[11] Patent Number: 5,106,457

[45] Date of Patent: Apr. 21, 1992

[54] HYDROENTANGLED NONWOVEN FABRIC CONTAINING SYNTHETIC FIBERS HAVING A RIBBON-SHAPED CRENULATED CROSS-SECTION AND METHOD OF PRODUCING THE SAME

[75] Inventor: James H. Manning, Neenah, Wis.

[73] Assignee: James River Corporation, Richmond, Va.

[21] Appl. No.: 569,975

[22] Filed: Aug. 20, 1990

[51] Int. Cl.[5] ..... D04H 1/46; D21H 13/10; D21H 25/08

[52] U.S. Cl. ..... 162/115; 28/105; 162/142; 162/146; 162/157.3; 162/157.4; 162/157.5; 264/177.13; 428/288; 428/297; 428/303; 428/393

[58] Field of Search ..... 28/105; 162/142, 157.4, 162/157.3, 157.5, 201, 204, 146, 115; 428/288, 297, 303, 393; 264/177.13

[56] References Cited

U.S. PATENT DOCUMENTS

| | | | |
|---|---|---|---|
| 3,156,607 | 11/1964 | Strachan | 264/177.13 |
| 3,485,706 | 12/1969 | Evans . | |
| 3,620,903 | 11/1971 | Bunting, Jr. et al. . | |
| 3,914,488 | 10/1975 | Gorrafa | 428/397 |
| 4,079,028 | 3/1978 | Emmons et al. . | |
| 4,144,370 | 3/1979 | Boulton . | |
| 4,152,480 | 5/1979 | Adachi et al. . | |
| 4,155,892 | 5/1979 | Emmons et al. . | |
| 4,196,245 | 4/1980 | Kitson et al. . | |
| 4,245,001 | 1/1981 | Philips et al. | 428/400 |
| 4,410,579 | 10/1983 | Johns . | |
| 4,442,161 | 4/1984 | Kirayoglu et al. . | |
| 4,498,956 | 2/1985 | Cheshire et al. . | |
| 4,612,237 | 9/1986 | Frankenburg . | |
| 4,753,834 | 6/1988 | Braun et al. . | |
| 4,774,110 | 9/1988 | Murakami et al. . | |
| 4,775,579 | 10/1988 | Hagy et al. . | |
| 4,778,460 | 10/1988 | Braun et al. | 428/397 |
| 4,783,231 | 11/1988 | Raley . | |
| 4,808,467 | 2/1989 | Suskind et al. . | |
| 4,822,452 | 4/1989 | Tse et al. . | |
| 5,009,747 | 4/1991 | Viazmensky et al. | 162/115 |

*Primary Examiner*—James C. Cannon
*Attorney, Agent, or Firm*—Finnegan, Henderson, Farabow, Garrett & Dunner

[57] ABSTRACT

A hydroentangled nonwoven fabric containing ribbon shaped staple synthetic fibers having a crenulated cross-section and formed from a wet-laid web containing such crenulated fibers, preferably a blend thereof with short natural fibers, such as wood fibers. The use of a wet-laid web containing such crenulated synthetic fibers enables optimal interaction with the hydroentanglement jets of water, and a reduced level of hydroentanglement energy is required to achieve the desired performance characteristics in the fabric.

15 Claims, 4 Drawing Sheets

12

14

12

HYDROENTANGLED NONWOVEN FABRIC CONTAINING SYNTHETIC FIBERS HAVING A RIBBON-SHAPED CRENULATED CROSS-SECTION AND METHOD OF PRODUCING THE SAME

FIELD OF THE INVENTION

This invention relates to nonwoven fabrics. In particular, this invention relates to such fabrics of improved strength and which contain synthetic fibers having a ribbon-shaped crenulated transverse cross-section, and a method of producing such fabrics.

BACKGROUND OF THE INVENTION

It is known to use a fluid, such as water, to rearrange the fibers of a nonwoven fabric to produce a fabric having fibers interconnected to each other. For example, U.S. Pat. No. 3,485,706 discloses a nonwoven fabric of randomly interentangled fibers in a repeating pattern of localized entangled regions interconnected by fibers extending between entangled regions, which does not use a binder material or the like. The process for making such fabric is described as supporting a layer of fibrous material, e.g., a web, batt, etc. of loose textile staple, paper, etc., fibers, continuous filament, etc., or combination thereon on an apertured patterning member and jetting streams of a liquid supplied at high pressure onto the fibrous material to entangle the fibers and form the fabric. This patent discloses the hydroentanglement of continuous filaments having a ribbon-shaped cross-section and of such filaments having a trilobal cross section. The apertured patterning member may be formed of woven screen or a perforated metal plate, with an open area of from about 10% to 98%. The type of process described therein is referred to herein as "hydroentanglement."

U.S. Pat. No. 3,620,903 discloses a nonpatterned nonwoven fabric which can be a blend of at least 20 per cent by weight of staple textile fibers, e.g., polyesters, acrylics, rayon, cotton, etc., and papermaking fibers, e.g., wood pulp and cotton linters, which have been hydroentangled. Exemplified are fabrics formed of tissue grade paper of wood-pulp fibers hydroentangled on a web of polyester textile fibers.

U.S. Pat. No. 4,442,161 discloses the hydroentanglement of wood-pulp and synthetic organic fibers. A layer of wood-pulp fiber is placed on top of a polyester layer and then the layers are hydroentangled using closely spaced jets to produce a nonwoven fabric having one side with relatively more wood pulp near its surface than the other.

It is also known, from U.S. Pat. No. 4,822,452, to form a fibrous web comprising wet-laid staple length natural or synthetic fibers and wood cellulose papermaking fibers on a papermaking machine using a water furnish of the fibers made up with a "nonionic associative thickener" in the absence of a conventional surfactant. The resulting fibrous web is a blend of the above fibers which is substantially uniform in composition across the thickness of the web.

Similarly U.S. Pat. No. 4,498,956 discloses the manufacture of a nonwoven fibrous web from a dispersion of fibers in a foamed liquid. In such method a water-surfactant solution is formed into a foamed liquid containing bubbles of air. The fibers are then dispersed in the foamed liquid to form a foamed furnish which is used to form a wet-laid web.

U.S. Pat. No. 4,783,231 discloses the formation of a nonwoven web of spun bonded continuous synthetic filaments which are crimped and which may have a circular, noncircular or trilobal cross-section.

U.S. Pat. No. 4,753,834 discloses nonwoven webs formed of bilobal monofilaments which, after drawing, are laid down on a moving belt to form the web.

U.S. Pat. No. 4,753,834 to Hagy et al. and U.S. Pat. No. 4,808,467 to Suskind et al. disclose the hydrogentanglement of a nonwoven web formed of a blend of wood pulp fibers and staple synthetic fibers. Such nonwoven webs are disclosed to be produced by conventional wet or dry papermaking methods.

U.S. Pat. No. 4,410,579 discloses a hydroentangled nonwoven fabric of 100% ribbon-shaped polyester staple fibers having improved disentanglement resistance. Such polyester fibers are disclosed as being generally rectangular or oval in shape, and the ratio of the length of the major axis to the length of the minor axis of the fiber cross-section is in the range of 1.8:1 to 3:1. The final nonwoven fabric is formed by hydroentangling an air-laid web of the polyester fibers.

Notwithstanding such improvements in nonwoven fabrics, it still is desirable to provide a nonwoven fabric of higher strength than that obtained by prior methods, which fabrics can be entangled more effectively and which can be produced with lower capital and operating costs.

After considerable effort directed to finding a nonwoven wood fiber/staple synthetic fiber fabric of improved tensile strength I have now found, unexpectedly, that a wet-laid web containing staple synthetic fibers, for example, polyester fibers, having a ribbon-shaped crenulated cross-section responds much better to water jet, hydroentanglement than a web made with fibers having a ribbon-like round or oval cross-section. I also have found that such a hydroentangled web containing such staple crenulated synthetic fibers quite unexpectedly has a better tensile strength, wet or dry, than its counterpart having a round, oval or smooth ribbon-like cross-section. This result was not expected from the data shown in U.S. Pat. No. 4,410,579 (see FIG. 2 thereof which shows that grab strength decreases as aspect ratio increases). Hence, I determined that a wet-laid web containing ribbon-shaped crenulated fibers does not respond to hydroentanglement in the same manner as a web of fibers which have carded or been air-laid and have a round, oval or smooth ribbon-shaped cross-section. In addition to the synthetic staple fiber cross-sectional shape, I have also discovered that the denier of the synthetic fibers has a significant influence upon the physical properties of a hydroentangled fabric. Further, I have found that the wet-laying method of forming the initial web to be hydroentangled significantly improves both the physical properties of the hydroentangled fabric and the effectiveness of the hydroentanglement treatment. Based upon the above findings, I have developed the present invention.

SUMMARY OF THE INVENTION

The present invention provides an improved nonwoven fabric and a method of producing the same which utilizes a selected type of staple synthetic fibers having a ribbon-like crenulated cross-section and which have been wet-laid. Accordingly, a general object of the present invention is to provide a nonwoven fabric of improved strength. The fabric of the present invention is useful for clothing and is particularly useful as a medical fabric.

Another object of the present invention is a high-strength nonwoven fabric which can be produced more economically.

A further object of the present invention is a method of forming a high-strength nonwoven fabric wherein a web containing staple length synthetic fibers having a ribbon-like crenulated cross-section can be more effectively hydroentangled to provide a fabric of improved strength and at a lower cost.

Still a further object of the present invention is a more economical nonwoven fabric formed of a blend of the above synthetic staple fibers and short natural fibers and having a greater resistance to disentanglement and resistance to piling.

Additional objects and advantages of the invention will become apparent from the following description, or may be learned by practice of the invention. The objects and advantages may be realized and obtained by the structural, compositional and operational features pointed out in the appended claims.

To achieve the foregoing objects and in accordance with the purpose of the invention, as embodied and broadly described herein, a high-strength nonwoven fabric is formed by wet-laying a web of at least 15% by weight, based upon the total weight of the fabric, of staple synthetic fibers having a ribbon-like crenulated transverse cross-section, which fibers are randomly interlocked with each other in a three dimensional matrix.

In one embodiment of the invention such fabric is formed of a blend of the above staple synthetic fibers and short natural fibers, preferably containing from about 15% to about 100%, by weight, of such staple synthetic fibers and from about 85% to about 0%, by weight, of short natural fibers, both based upon the total weight of the fabric.

In forming the fabric of the present invention it is necessary to first form a wet-laid web formed from a water furnish of fibers containing at least 15% by weight of staple synthetic fibers having a ribbon-shaped crenulated transverse cross-section. In one preferred embodiment the water furnish is made up using of an "associative thickener", as will be described hereinbelow. In another preferred embodiment a foamed furnish of water, a surfactant and fibers is employed. In the resulting prehydroentangled web the synthetic fibers should lay substantially flat relative to the plane of the fabric. The wet-laid web is then efficiently subjected to hydroentanglement using streams of water.

BRIEF DESCRIPTION OF THE DRAWINGS

The accompanying drawings, which are incorporated in and constitute a part of the specification, illustrate presently preferred embodiments of the present invention, and, together with the description, serve to explain the principles of the invention.

In the drawings.

DESCRIPTION OF PREFERRED EMBODIMENTS

Reference will now be made in greater detail to the present preferred embodiments of the present invention.

The present invention utilizes staple synthetic fibers which are typically shaped like a ribbon, i.e., elongated fibers wherein the width, or the longer dimension transverse to the longitudinal axis thereof, is greater than the thickness, or the shorter dimension transverse to the longitudinal axis of the fibers. The outline of the transverse cross-section of the fibers is crenulated, i.e., it is wavy or serrated. Sometimes such fibers may be referred to herein as having a scalloped oval transverse cross-section. The use of such crenulated fibers is extremely important to the attainment of a fabric having the desired properties and advantages. Such fibers are sometimes hereinafter referred to as "crenulated fibers."

Figure 1:
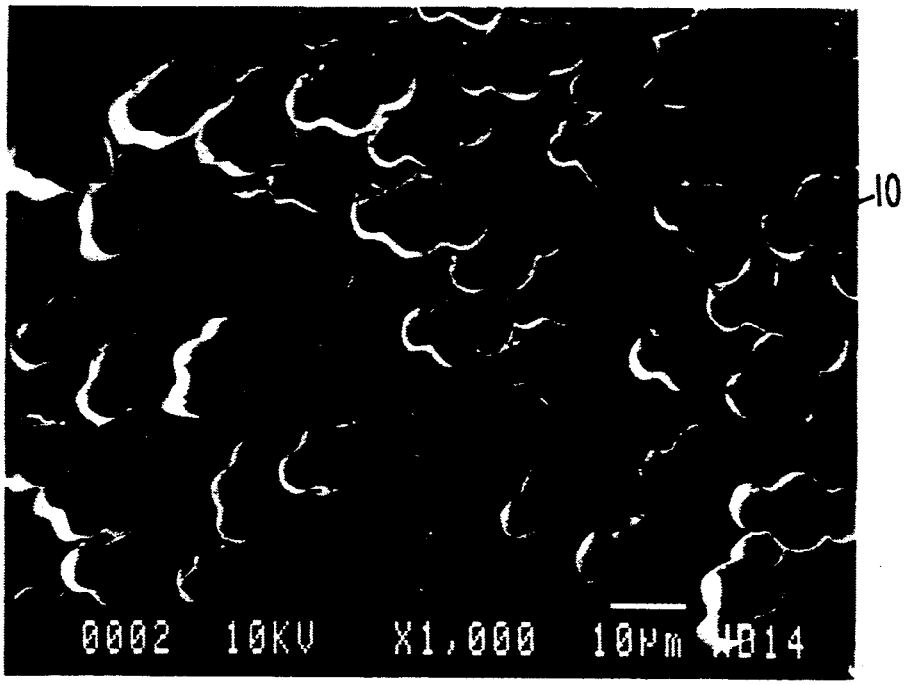
FIG. 1 is a photograph showing the crenulated transverse cross-sections of one type of synthetic fiber employed in the fabric of the present invention.
Figure 2:
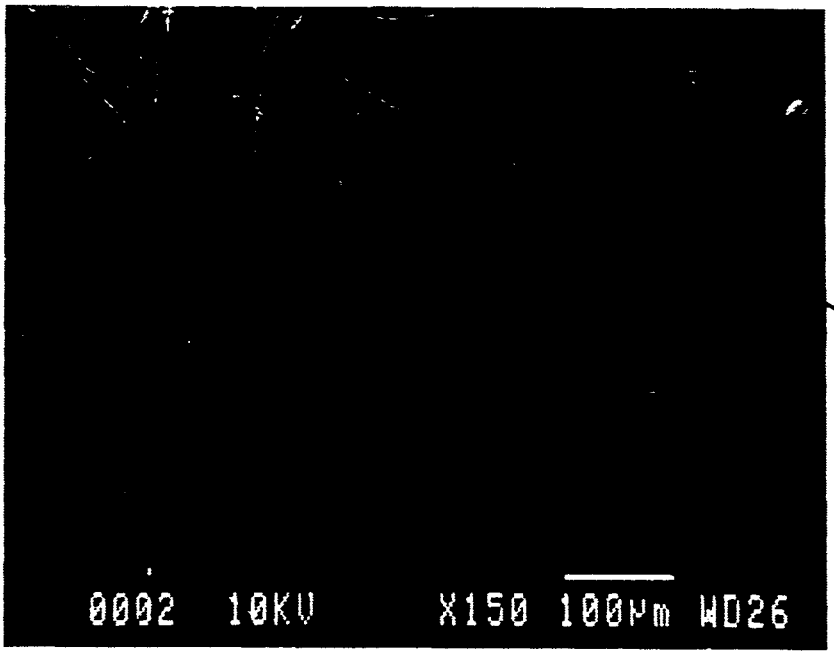
FIG. 2 is a photograph of the surface of a wet-laid web, prior to hydroentanglement, of a blend of wood fibers and ribbon-shaped crenulated synthetic fibers according to the present invention illustrating one optimal configuration for hydroentanglement of the fibers.

The crenulated synthetic fibers employed in the present invention may be made from synthetic polymers such as polyesters, e.g., polyethylene terephthalate; polyolefins, e.g., homopolymers and copolymers of polypropylene; acrylic, e.g., acrylonitrile or methyl methacrylate; polyamides, e.g., any of the various nylons; and polyaramids, e.g., Kevlar (E. I. duPont de Nemours & Co.), or from semi-synthetic materials such as rayon. Polyester fibers are a preferred type of synthetic fibers for use in the present invention. Such crenulated fibers can be produced by well-known techniques, such as melt spinning from generally rectangular orifices having a crenulated, or scalloped, periphery. One especially suitable crenulated fiber is D-195 Dacron, manufactured by E. I. duPont de Nemours & Co., which is a polyester fiber made from polyethylene terephthalate. As shown in FIG. 1, the transverse cross-sections of the D-195 Dacron fibers 10 have outlines which are crenulated, or scalloped, with a larger, central portion flanked by smaller lateral portions. Another suitable crenulated synthetic fiber is TM 14N, manufactured by Teijin Limited, which is a polyester ribbon-like fiber 12, as shown in FIG. 2 having four striations along its broader flat surface.

The crenulated synthetic fibers used in the fabric of the present invention are of staple length and typically have a denier in the range of about 0.5 to 5 and a length in the range of about ½ inch to 2 inches. Preferably, however, such fibers are in the size range of about 0.5 to 4.0 denier by about ½ inch to about 1 inch long. Particularly desirable are crenulated polyester fibers of about 1.2 denier × ¾ inch long. In general, fibers of smaller deniers and longer lengths result in more desirable physical properties.

The above ribbon-shaped crenulated staple synthetic fibers should constitute at least 15% by weight of the total weight of the fabric, and up to 100% by weight may be used in the present invention. It is, however, advantageous to use a blend of the crenulated synthetic fibers and short natural fibers, the blend containing from about 15% to 90% by weight of the crenulated fibers and from about 85% to 10% by weight of the short natural fibers, and preferably, the blend contains from about 30% to 50% by weight of the crenulated fibers and from about 50% to about 70% by weight of the short natural fibers, all based upon the total weight of the fabric. A particularly suitable blend has been found to be one containing about 40% by weight of crenulated polyester fibers and about 60% by weight of northern softwood pulp.

The short natural fibers used in forming the blended fabric should be long, thin and flexible, since such fibers will more readily become entangled and interlocked with the crenulated staple synthetic fibers. Most preferably, wood fibers obtained from northern softwoods such as redwood, western red cedar or eastern white pine are used as the source of the short material fibers. Cotton linters or other papermaking fibers can also be used. The short natural fibers preferably have an average length of from about 3 to 6 millimeters.

Figure 3:
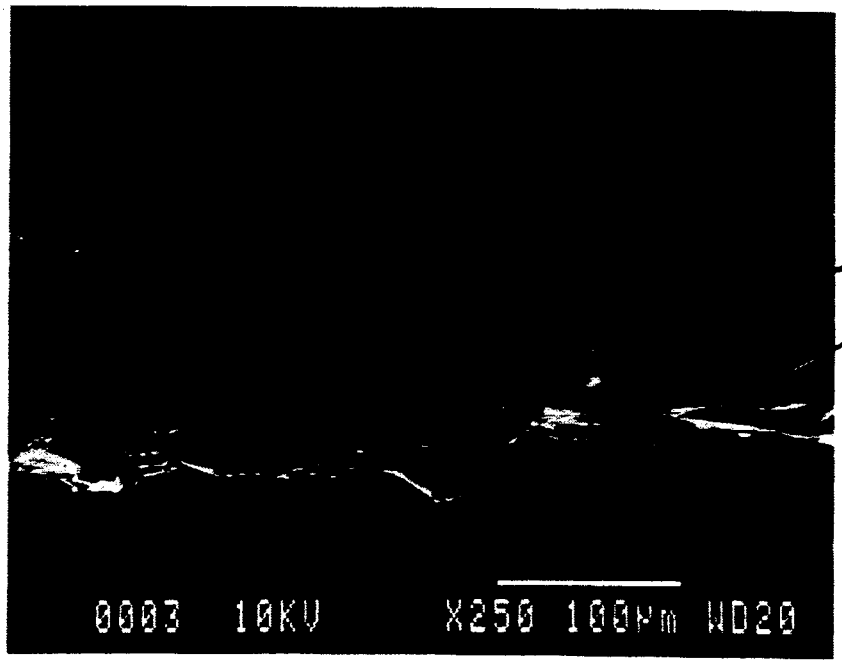
FIG. 3 is a cross-sectional view of the fabric of FIG. 2.

In forming the web of a blend of crenulated synthetic fibers and short natural fibers it is important that both types of fibers be uniformly blended and distributed uniformly throughout the web. Such a uniform distribution is shown in FIG. 3, wherein it may be seen that both of the wood fibers 14 and the staple synthetic fibers 12 are uniformly distributed across the thickness of the fabric.

In forming the web to be hydroentangled, it has been found that the use of a wet laying process enables a more uniform distribution of the fibers in the pre-blend web. Further, as shown in FIG. 2, wet laying results in a substantial portion of the crenulated synthetic fibers and the wood fibers lying substantially flat, or parallel, to the plane of the web. This results in an optimal configuration for subsequent hydroentanglement, because the water is jetted against the broader, flatter surface of a ribbon-like fiber in a stream which is substantially perpendicular to the flat surface. Therefore, the fiber will have minimal bending stiffness, while having maximum interaction with the water, due to a maximal area of the fiber being contacted by the water jets striking the web. This generally improves the effectiveness of hydroentanglement and also contributes to the formation of a smoother final fabric. On the other hand, the use of air laying or like techniques results in the fibers having a random orientation in the web and such fibers do not respond as well to hydroentanglement.

While various wet laying techniques, well known in the papermaking art, may be used to form the wet laid web, an especially advantageous wet laying method is described in U.S. Pat. No. 4,822,452, which is incorporated herein by reference.

In accordance with such method a dispersion of fibers in water is made up with a small amount of an "associative thickener" which acts both as a surfactant (or dispersant) and as a thickener, slightly increasing the viscosity of the water carrier medium and acting as a lubricant for the fibers. Such materials are hereinafter, referred to or "associative thickeners". One class of nonionic associative thickeners preferred in the process of this invention comprises relatively low (10,000 to 200,000) molecular weight ethylene oxide based urethane block copolymers and is disclosed in U.S. Pat. Nos. 4,079,028 and 4,155,892. Commercial formulations of these copolymers are sold by Rohm and Haas, Philadelphia, Pa., under the trade names Acrysol RM-825 and Acrysol Rheology Modifier QR-708, QR-735 and QR-1001 which comprise urethane block copolymers in different carrier fluids. Acrysol RM-825 is a 35 percent solids grade of polymer in a mixture of 25 percent butyl carbitol (a diethylene glycol monobutyl ether) and 75 percent water. Acrysol Rheology Modifier QR-708, a 35 percent solids grade in a mixture of 60 percent propylene glycol and 40 percent water, has been found to produce excellent results.

Similar copolymers in this class, including those marketed by Union Carbide Corporation, Danbury, Conn. under the trade names SCT-200 and SCT-275 and by Hi-Tek Polymers under the trade name SCN 11909, are useful in the process of this invention.

In a preferred method of forming the pre-blend web, the aqueous dispersion, and the ultimate fabric, typically comprises at least about 15 percent, preferably from about 15 to about 90 percent, by weight, of staple length ribbon-shaped crenulated synthetic fibers and from 85 to 10 percent, preferably from about 70 to about 30 percent, by weight, wood fibers. Synthetic fibers in the size range of about 0.7 to 1.5 denier by about ½ to ¾ inch are preferred. Especially suitable staple fibers include polyester fibers, e.g., those sold under the trade names Trevira, Dacron, Kodel, Fortrel, etc.; acrylic fibers, e.g. those sold under the trade names Creslan, Acrilan, Orlon, etc.; polyamide fibers, e.g., nylons, polyolefin fibers, e.g., polypropylene; and modified acrylic fibers, including those sold under the trade name Dynel.

Preferably, the wood fibers are dispersed in water prior to adding the associative thickener, followed by the addition of the associative thickener in an amount in the range of from 1 to 150 pounds per ton of dry fiber making up the furnish and then the addition and dispersion of the staple length fibers. Finally, the dispersion of mixed fibers in an unfoamed water carrier is diluted to the desired headbox consistency and dispensed onto the forming wire of a conventional papermaking machine. An anti-foam agent may be added to the dispersion to prevent foaming, if necessary, and a wetting agent may be employed to assist in wetting the staple length fibers if desired.

The fibers preferably are made up into an aqueous dispersion suitable for wet forming on a moving wire former in the following manner. The wood pulp is first dispersed in water or in recycled white water to a consistency of about 1 to 2 percent. Then a nonionic associative thickener is added to the resulting slurry in an amount within the range of about 100 to 500 ppm, preferably in the range of 25 to 100 ppm, followed by the addition of the textile length fibers with continuous mixing under low shear conditions. After the fibers are thoroughly blended, the slurry is further diluted with fresh water and white water to the final headbox furnish consistency, preferable to a consistency in the range of 0.01 to 0.5 percent with a nascent viscosity in the range of 1.21 to 2.54 centiposes at 30° C., and supplied to the headbox of a papermaking machine. The pre-blend web may be formed from the fiber furnish on high speed conventional Foudrinier papermaking machines to produce a strong, uniform product of excellent formation. And in which the fibers forming the wet-laid product lie substantially flat, i.e., the broader surfaces of the fibers are substantially parallel to the plane of the web.

Another highly advantageous wet laying technique which may be used to form the pre-blend wet-laid web in accordance with the present invention is described in U.S. Pat. No. 4,498,956, the disclosure of which is incorporated herein by reference. In such technique a foamed fiber furnish is forming by dispersing the fibers in a foamed liquid comprising water and a surface active agent and containing about 55 to 75 percent, by volume, of air. The air is in the form of bubbles, typically having an average diameter in the range of about 20 to 200 microns. The foamed furnish is passed from a water headbox, engages a forming roll and is squeezed between two wires so as to force the liquid through the wire. The web is then carried from the forming roll for further processing.

The pre-blend web is preferably formed to have a basic weight of from about 1 oz./yd.$^2$ up to about 4 oz./yd.$^2$. If lighter than 1 oz./yd.$^2$, during the hydroentanglement treatment the water jets tend to cut the web, and, if heavier than 4 oz./yd.$^2$, the water jets tend not to penetrate the web uniformly and this results in a less uniform fabric.

After the wet-laid pre-blend web is formed it may, if desired, be subjected to additional treatment, such as drying and/ or calendering prior to the hydroentanglement treatment to provide a "two-stage" process for forming the final fabric. Alternatively, a "one-stage" process may be employed wherein the wet-laid web is passed directly, after pressing if so-required, to the hydroentanglement step. Usually, a single wet-laid web is hydroentangled to form the final fabric; however, depending upon the basis weight of the web, but, if so-desired, a plurality of, e.g., two, such webs may be laid one upon the other and subjected to hydroentanglement.

In the hydroentanglement step, the wet-laid web, or webs, is supported on a suitable apertured forming surface and multiple streams, e.g., jets of a fluid, such as water, are directed under high pressure onto one of the planar surfaces of the web, usually the top surface, to rearrange the fibers of the web so that they become randomly entangled, or interlocked, with one another in a three dimensional matrix so as to result in a strong, coherent fabric. Typically, the forming surface is a wire mesh screen, ranging from 150 mesh to 20 mesh, depending upon the pattern desired in the final fabric. For example, if a non-apertured fabric is desired a smooth, fine mesh screen is used, and if an apertured fabric is desired a coarser screen is used. Multiple passes under the water jets may be used, and the various passes may utilize various combinations of fluid pressure and orifice sizes. U.S. Pat. No. 3,485,706, which is incorporated herein by reference, discloses hydroentanglement conditions which are suitable for use in the present invention, as does U.S. Pat. No. 4,410,579, which is also incorporated herein by reference. Additionally, the hydroentanglement step may use the method disclosed in U.S. Pat. No. 4,152,480, which is incorporated herein by reference. In the latter method a high speed liquid jet stream is expelled from a slit-shaped nozzle, rather than circular nozzles, onto a web supported on a forming surface.

To illustrate the advantages of the present invention a number of nonwoven fabrics number of 1.5 oz./yd.$^2$ hand sheets, or webs, were made containing 70 weight percent staple polyester fibers and 30 weight percent wood pulp (Marathon OSWK). These webs were wet-laid using 100 ppm of Acrysol Rheology Modifier QR-708, an associative thickener, for dispersion. All hand sheets, or webs, were dried and subjected to hydroentanglement using a header having 40 holes per inch in a straight line, the holes being of 0.005 inch diameter and of standard shape. Water was jetted onto the top surface of each of the webs using 2 passes at 200 psig and 6 passes at 800 psig. The sheets were hydroentangled by passing them under the water jets at a standard speed of 240 feet per minute. Following the hydroentanglement, the sheets were dried unrestrained and without pressing. The above webs were made with various D-195 Dacron polyester fibers having a range of deniers of from 0.5 to 1.5, a range of lengths of from 0.5 to 1.0 inch and with two different cross-sections, round and ribbon-shaped crenulated, i.e., scalloped oval.

The procedures used in determining the various physical properties, referred to hereinbelow, of the hydroentangled fabrics are identified as follows:

Basis Wt.—TAPPI Method T-410-OM-88
Caliper—TAPPI Method T-411-OM-84
Tensile—TAPPI Method T-494-OM-88
Tear—TAPPI Method T-414-OM-88

Figure 4:
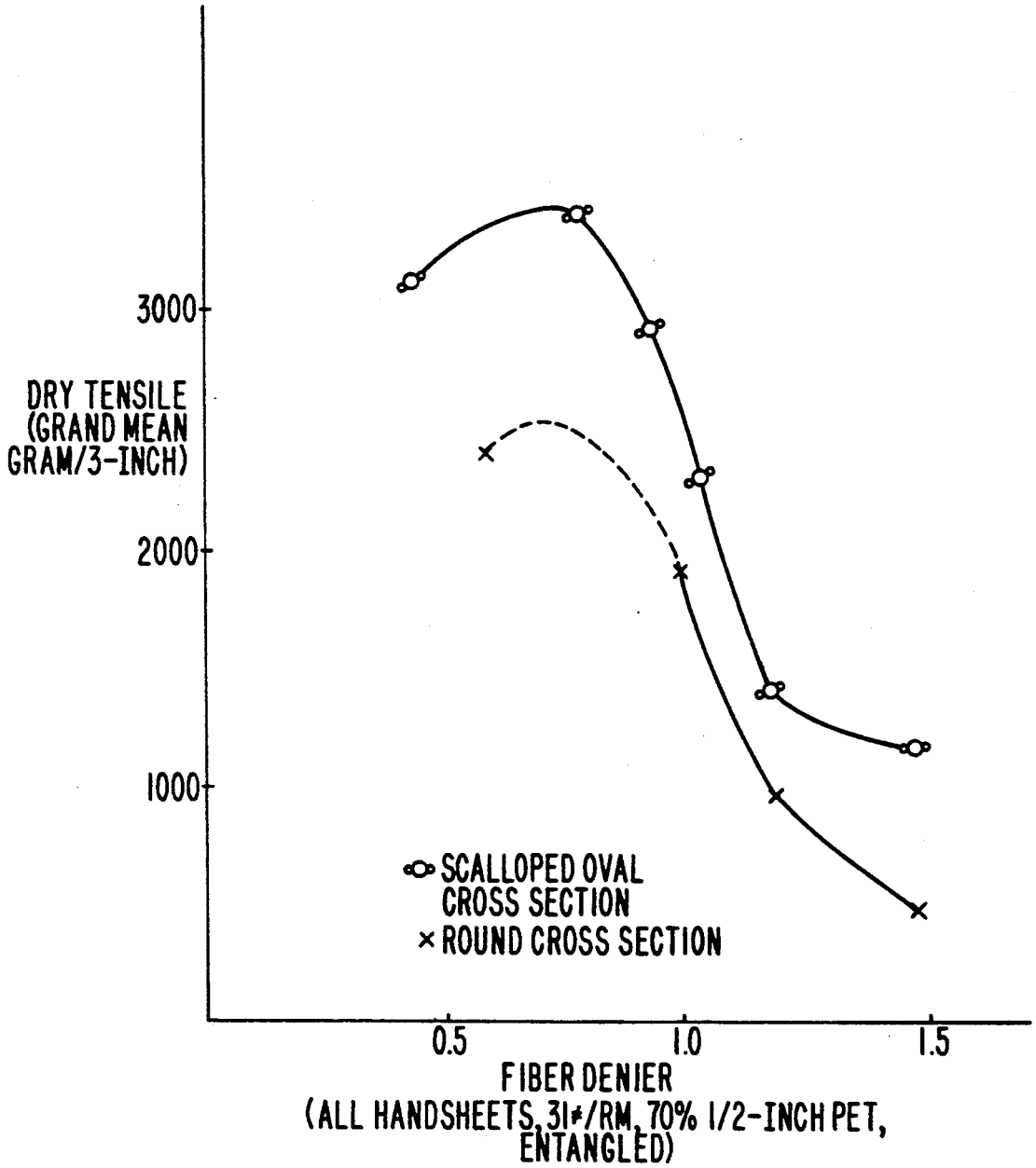
FIG. 4 is a plot of dry tensile vs. fiber denier showing the effect of fiber denier and shape upon the dry tensile strength of hydroentangled fabrics.

A summary of the physical properties of the hydroentangled webs, all made with ½ inch long polyester fibers, is shown in Table 1. As shown in FIG. 4, the dry tensile values were plotted for the various deniers and both types of cross-sections. As seen in FIG. 4, a remarkable, consistent advantage in dry strength for the fabrics made with the scalloped oval cross-section polyester fibers resulted for all deniers, with the dry strength peaking at 0.8 denier. The fabric having 0.8 denier by ½ inch long scalloped oval polyester fibers had a dry strength of 3,411 g/3-inch, while the fabric made with the 1.5 denier by ½ inch long round polyester fiber had a dry strength of only 484 g/3-inch.

TABLE 1

EFFECT OF FIBER DENIER AND SHAPE OF HYDROENTANGLED HAND SHEET PROPERTIES

| Sample No./ Denier | Basis Wt. (lb/rm) | Caliper (4 ply mils) | Tensile (g/3" dry) | Tear (grams) MD | | CD | Opacity (%) |
|---|---|---|---|---|---|---|---|
| SCALLOPED OVAL | | | | | | | |
| 74/0.5 | 30.66 | 74 | 3226 | 838 | × | 844 | 68.6 |
| 75/0.8 | 32.18 | 85.5 | 3411 | 1043 | × | 1254 | 61.8 |
| 78/0.95 | 31.11 | 83.8 | 2932 | 1056 | × | 1027 | 57.3 |
| 77/1.03 | 31.21 | 88.5 | 2411 | 1184 | – | * | 57.2 |
| 76/1.2 | 30.83 | 87.0 | 1513 | 1128 | – | * | 57.4 |
| 70/1.5 | 32.48 | 92.5 | 1335 | 1104 | – | * | 53.3 |
| ROUND | | | | | | | |
| 72/0.6 | 31.98 | 79.8 | 2421 | 819 | × | 894 | 53.3 |
| 73/1.0 | 30.98 | 86.5 | 1820 | 953 | – | * | |
| 79/1.2 | 31.14 | 94.8 | 965 | 1004 | – | * | 48.1 |
| 66/1.5 | 38.1 | 98 | 484 | 220 | – | * | 55 |

* Did not tear in Cross Direction

Also, determined was the effect of fiber length on the physical properties of the above fabrics made with both round and scalloped oval polyester fibers. Table 2 summarizes physical property data for fabrics made with ½ inch and 1 inch long 1.5 denier polyester fibers having round and scalloped oval cross-sections. As seen in Table 2, there was a improvement in both wet and dry tensile values for the fabrics made with the polyester fibers having scalloped oval cross-sections, and the longer 1 inch long fibers resulted in significantly greater tensile values.

TABLE 2

COMPARISON OF PHYSICAL PROPERTIES OF HYDROENTANGLED HAND SHEET WITH FIBERS OF ROUND AND SCALLOPED OVAL CROSS SECTION

| | 70% 1.5 Dacron | | | |
|---|---|---|---|---|
| | 1" Round | 1" Sc. Oval | ½" Round | ½" Sc. Oval |
| Basis Wt., lb/rm | 31.32 | 32.31 | 38.1 | 32.48 |
| Caliper, 4 ply mils | 85 | 97.3 | 98 | 92.5 |
| Dry Tensile, g/1-inch | | | | |
| MD | 2701 | 3968 | 664 | 1666 |
| CD | 2099 | 3061 | 353 | 1070 |
| Wet Tensile, g/inch | | | | |
| MD | 2119 | 2886 | 680 | 977 |
| CD | 1995 | 3116 | 287 | 235 |
| Dry Elongation, % | | | | |
| MD | 46.2 | 47.9 | 33.9 | 55.0 |
| CD | 47.1 | 52.9 | 16.9 | 54.4 |
| Elmendorf Tear, grams MD | 1174 | 1298 | 220 | 1104 |
| Opacity, % | 45.3 | 62.8 | 55.1 | 53.3 |

The data given in Table II and FIG. 2 of U.S. Pat. No. 4,410,579 substantiates the positive influence of fiber cross-sectional shape on the increase in resistance to disentanglement of hydroentangled fabrics. This patent discloses that, for 100% polyester fiber dry-laid fabrics which were made from fibers having a ribbon-shaped, rather than a round, cross-section and hydroentangled at relatively high pressures, the resulting fabrics had improved resistance to disentanglement and resistance to piling; however, the grab tensile goes down as the aspect ratio increases. The present invention, however, as a result of using wet-laying to form a unique geometric structure in the pre-blend web, enables optimal interaction with the hydroentanglement jets of water. The present invention also enables the use of less polyester to achieve a given strength or to obtain a superior strength at the same polyester content, while using a lesser amount of hydroentanglement energy to obtain the desired performance characteristics in the fabric.

Figure 5:
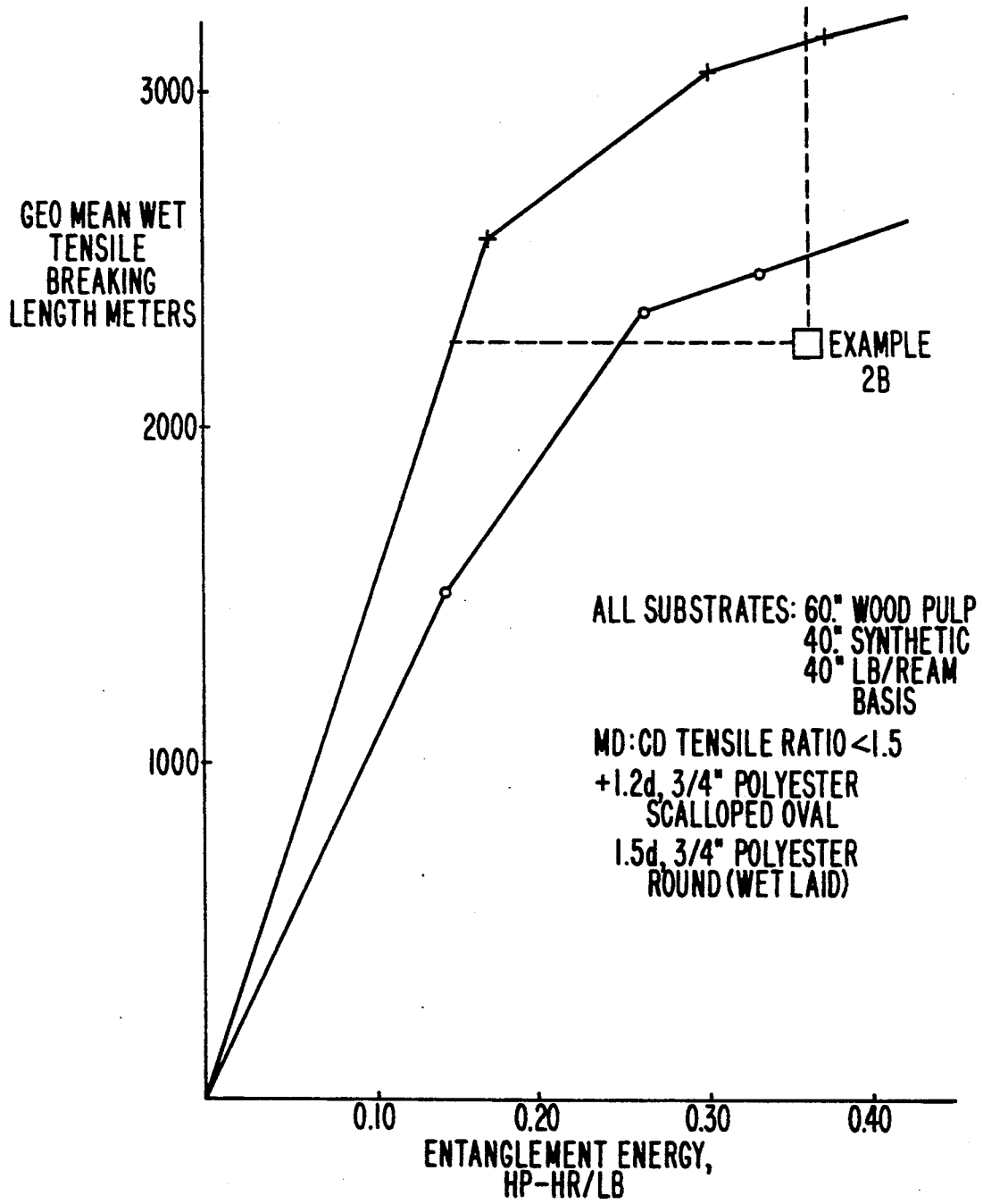
FIG. 5 is a plot of entanglement energy vs. geometric mean tensile breaking length in meters for hydroentangled fabrics containing synthetic staple fibers of different lengths and deniers. These synthetic fiber webs had been wet-laid as a preblend web with 60% softwood pulp and 40% synthetic fiber.

FIG. 5 is a plot of the hydroentanglement energy versus the geometric mean wet tensile breaking length in meters for two hydroentangled fabrics, each made of a blend of 60% northern softwood fibers and ¾ inch long polyester fibers. Both fabrics were made from wet-laid webs, but one contained scalloped oval polyester fibers, while the other contained round polyester fibers. The geometric mean tensile mean breaking length is the square root of the product of the machine direction (MD) tensile breaking length times the cross direction (CD) tensile breaking length. The geometric mean (G.M.) is used in order to negate as much as possible the effects of MD:CD tensile variations in the webs, and breaking length is used to normalize the data for slight changes that might occur in the basis weight. As seen in FIG. 5, the fabrics made with the scalloped oval cross-section polyester fibers entangles and achieves a higher strength level more easily than a similar fabric made with polyester fibers having a round cross-section. The shaded area shown in FIG. 5 represents the hydroentanglement energy and physical properties for a fabric similar to the fabric of the present invention, but made in accordance with Example 2B of U.S. Pat. No. 4,442,161 (referred to herein or as "Example 2B"), which was formed from a dry-laid web of a blend of wood fibers and crimped round polyester staple fibers. Table 3 provides more complete data on the comparison tests referred to above and which was used in plotting the curve shown in FIG. 5.

TABLE 3

Performance Attributes of Hydroentangled Fabrics with Different Fiber Cross Section and Length

| Trial Number | LSPM #3251-2 | LSPM 3252-1 | HSPM 2360-4 | Example 2B |
|---|---|---|---|---|
| Fiber Furnish | 60% Marathon OSWK | | | 60% W. Cedar |
| | 40% 1.2d, ¾" S.O PET | 40% 1.2d, ½" S.O PET | 40% 1.5d, ¾" Round PET | 40% 1.35d, ¾" Round PET-Crimped |
| HEF Energy, hp-hr/lb | 0.1657 | 0.3902 | 0.3255 | 0.360 |
| Basis Weight, lb/rm | 37.0 | 35.2 | 41.2 | 41.2 |
| Caliper, mils | 21.6 | 22.6 | 25.8 | N/A |
| % Elongation, | | | | |
| MD | 50.1 | 48.5 | 43.3 | 23 |
| CD | 43.3 | 50.8 | 53.9 | 76 |
| Tensile Breaking Length, Meters | | | | |
| G.M. Dry | 2763 | 2720 | 2402 | 2288 |
| G.M. Wet | 2578 | 2487 | 2481 | 2288 |
| Tear, grams | | | | |
| MD | 733 | 461 | N/A | N/A |
| CD | 739 | 576 | N/A | N/A |
| Mullen Dry pts | 48.4 | 36.7 | N/A | 45 |

MD = Machine Direction
CD = Cross-machine Direction
d = denier
S.O = Scalloped Oval
PET = Polyethylene Terephthalate Based upon the foregoing, I have determined that the properties of Example 2B, which is representative of a premium commercial fabric, can be obtained by hydroentangling a wet-laid web formed of a blend of wood fibers and staple length ribbonshaped synthetic fibers which have a crenulated cross-section, for example scalloped oval polyester fiber (1.2 denier × ¾ inch length), while using less than one-half the hydroentanglement energy.

Having described preferred embodiments of the present invention, it is recognized that variations and modifications thereof falling within the spirit of the invention may become apparent to those skilled in the art, and the scope of the present invention will be determined by the appended claims and their equivalents.

What is claimed is:

1. A high strength nonwoven wet-laid hydroentangled fabric formed of at least 15% by weight, based upon the total weight of the fabric, of staple synthetic fibers, said synthetic fibers having a ribbon-shaped crenulated transverse cross-section and being randomly interlocked with each other in a three-dimensional matrix.

2. The fabric of claim 1, wherein said fibers in said web have transverse cross-sections wherein the widths thereof are greater than the thicknesses thereof and the surfaces across the widths of a substantial portion of said synthetic fibers were substantially parallel to the plane of said web prior to hydroentanglement.

3. The fabric of claim 1, wherein said fabric is comprised of a blend of said staple synthetic fibers and short natural fibers.

4. The fabric of claim 3, wherein said natural fibers are wood fibers.

5. The fabric of claim 3, wherein said synthetic fibers are formed of polyester, acrylic, polyamide, or polyolefin resins.

6. The fabric of claim 1, wherein said staple synthetic fibers are in the size range of about 0.5 to 4.0 denier by about ½" to 1" long.

7. The fabric of claim 1, wherein a substantial portion of said synthetic fibers in said wet-laid web have the widths thereof substantially parallel to the plane of said web.

8. A method of forming a high-strength nonwoven fabric comprising forming a wet-laid web containing at least 15%, by weight, of staple synthetic fibers having a ribbon-shaped crenulated transverse cross section and hydroentangling said wet-laid web under hydroentanglement conditions so as to cause said staple fibers to become randomly interlocked with each other.

9. The method of claim 8, wherein said staple synthetic fibers of said web have a transverse cross-section wherein the width thereof is greater than the thickness thereof and wherein a substantial portion of the surfaces across the widths thereof are substantially perpendicular to the plane of said fabric.

10. The method of claim 8 wherein said web is formed from an aqueous dispersion of said fibers containing an associative thickener.

11. The method of claim 8, wherein said web is formed from a foamed furnish comprising a dispersion of said fibers in a foamed liquid comprising water and a surface active agent.

12. The method of claim 8, wherein said web is formed of a uniform blend of said synthetic fibers and short natural fibers.

13. The method of claim 15, wherein said blend comprises from about 15% to about 90%, by weight, of said synthetic fibers and from about 85% to about 10%, by weight, of said short natural fibers, both based upon the total weight of said web.

14. The method of claim 8, wherein said synthetic fibers are polyester fibers and said short natural fibers are wood fibers.

15. The method of claim 12, wherein said synthetic fibers are polyester fibers and said short natural fibers are wood fibers.

* * * * *